United States Patent [19]

O'Connor

[11] Patent Number: 4,726,765

[45] Date of Patent: Feb. 23, 1988

[54] COMBUSTOR DRUM HOLE SHIELDS

[75] Inventor: Chadwell O'Connor, Newport Beach, Calif.

[73] Assignee: Westinghouse Electric Corp., Pittsburgh, Pa.

[21] Appl. No.: 78,449

[22] Filed: Jul. 27, 1987

Related U.S. Application Data

[63] Continuation of Ser. No. 942,567, Dec. 15, 1986, abandoned.

[51] Int. Cl.[4] ..... F27B 7/14

[52] U.S. Cl. ..... 432/118; 432/77; 110/246

[58] Field of Search ..... 110/246; 432/77, 116, 432/118

[56] References Cited

U.S. PATENT DOCUMENTS

| | | | |
|---|---|---|---|
| 3,822,651 | 7/1974 | Harris et al. | 432/116 |
| 4,066,024 | 1/1978 | O'Connor | 110/246 |
| 4,226,584 | 10/1980 | Ishikawa | 432/118 |

*Primary Examiner*—Henry C. Yuen

*Attorney, Agent, or Firm*—F. J. Baehr, Jr.

[57] ABSTRACT

A combustor formed of a plurality of water cooled pipes secured as a drum by members defining a plurality of holes between the pipes, the drum being mounted for rotation at an angle, with there being low U-shaped walls surrounding the sides and high ends of the holes so that aluminum melted by burning material in the drum is guided around the holes while that material flows to the lower end of the drum.

2 Claims, 3 Drawing Figures

20
28
29
21
12
27
27
19
14
23
2
2
2
10
24
33
18
23
11
13
31
34
33

COMBUSTOR DRUM HOLE SHIELDS

This application is a continuation, of application Ser. No. 6,942,567, filed Dec. 15, 1986, now abandoned.

This invention relates generally to rotary kilns or drums for burning waste and more particularly concerns protecting such installations from molten metal occurring as a result of the burning.

U.S. Pat. No. 3,822,651, issued June 9, 1974, discloses an installation for burning MSW (municipal solid waste) and generating useful steam. Burning takes place in a combustor drum consisting of a long cylindrical structure formed by water circulating pipes slowly rotating on the drum axis. The drum is inclined at a slight angle so that material to be burned which is dumped in the higher end gradually tumbles toward the lower end. Air for burning is fed through holes formed between the pipes making up the cylindrical drum wall, with the air flow being controlled by ducts fitting adjacent the lower portions of the rotating drum.

The speed of drum rotation, air flow, rate at which material to be burned is added, and other factors are balanced so that burning is substantially completed within the drum and only ashes and any nonburnable material is discharged from the lower end of the drum. When the combination is handling MSW, one of its advantages is that no sorting or classification of the material to be burned is required. Nonburnable items simply pass through the drum and are carried away with the ashes.

It has been found that modern MSW includes significant quantities of aluminum, from cans and other forms of packaging. Temperatures in the combustor exceed the melting temperature of aluminum, with the result that as the burning of MSW proceeds, quantities of molten aluminum accumulate in the lower portion of the drum and can spill through the air openings in the drum wall into the air ducts. Cleaning the effects of this kind of aluminum discharge is difficult, making this a substantial problem in the handling of MSW.

Accordingly, it is the primary aim of the invention to insure that when burning MSW in a combustor drum, molten aluminum is carried through to the discharge end of the drum where it will fall into the ash pit for conventional handling.

Another object of the invention is to provide for control of molten aluminum in a combustor drum in an economical fashion, both initially and without continuous maintenance requirements.

Other objects and advantages of the invention will become apparent upon reading the following detailed description and upon reference to the drawings, in which.

Figure 1:
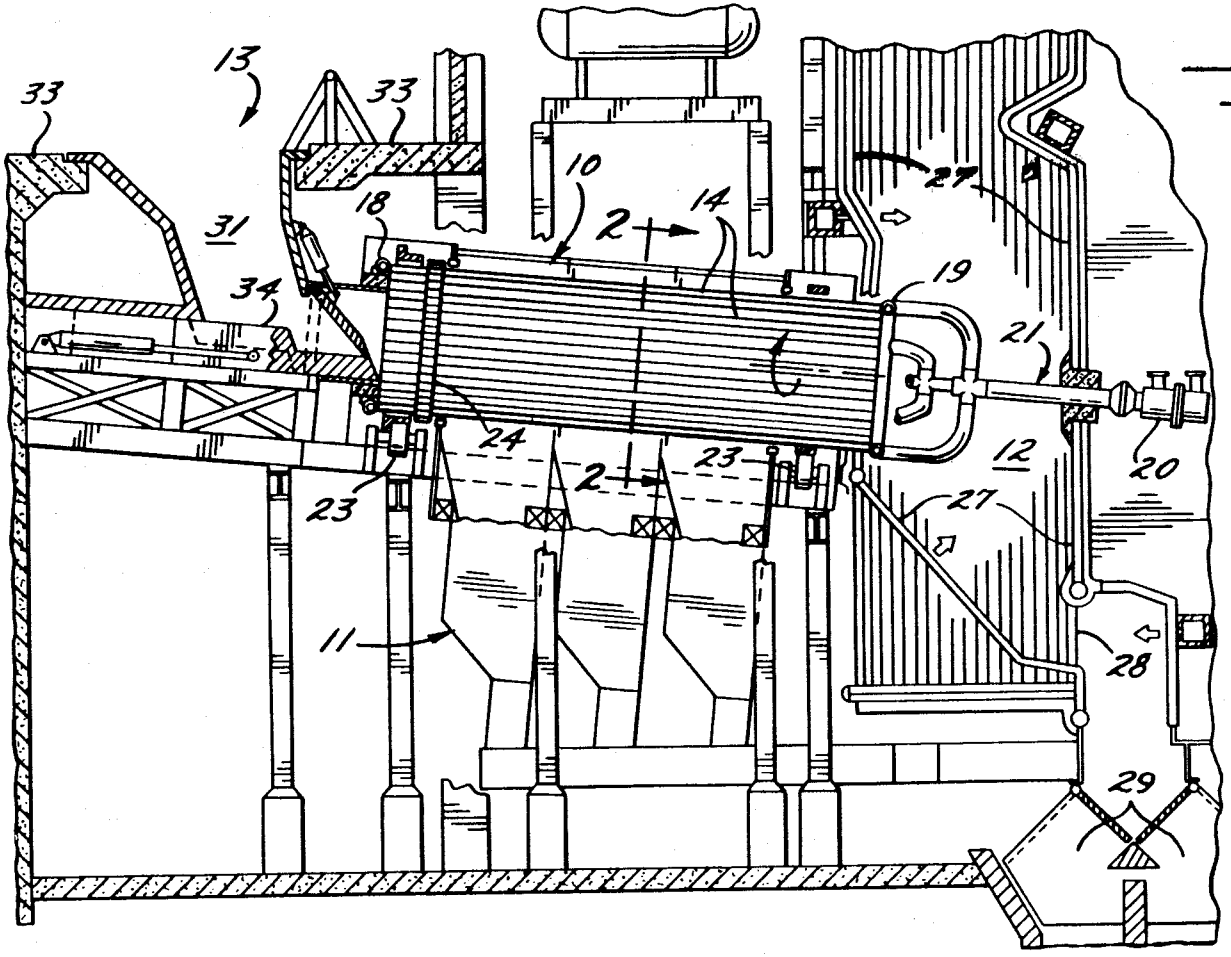
FIG. 1 is a fragmentary partially sectioned elevation of a struction for burning MSW including a combustor embodying the invention.
Figure 2:
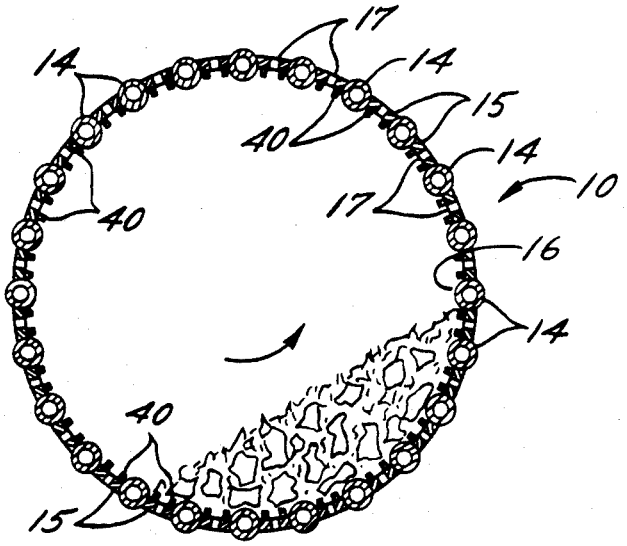
FIG. 2 is a fragmentary section taken approximately along 2—2 in FIG. 1.
Figure 3:
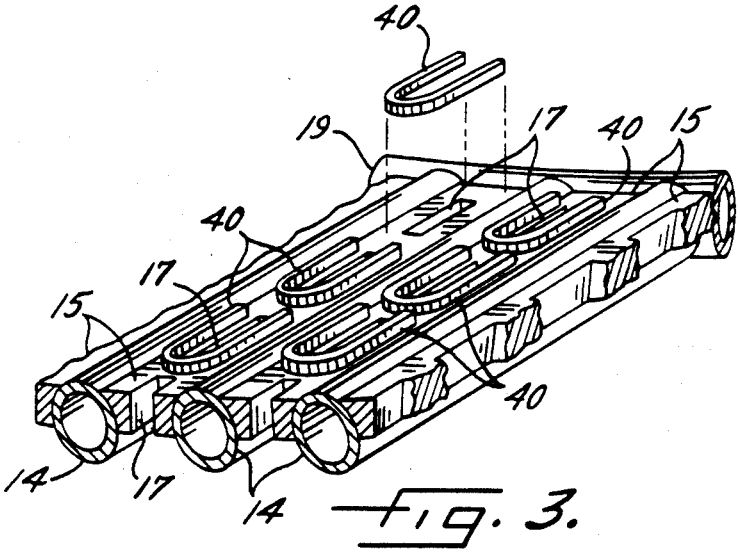
FIG. 3 is fragmentary perspective of a portion of the end wall of the drum shown in FIG. 2.

While the invention will be described in connection with a preferred embodiment, it will be understood that I do not intend to limit the invention to that embodiment. On the contrary, I intend to cover all alternatives, modifications and equivalents included within the spirit and scope of the invention as defined by the appended claims.

Turning to the drawing, there is shown a structure for burning material such as MSW and including a rotary combustor drum 10 with a wind box 11 for delivering air to the combustor 10, a furnace 12, and an arrangement 13 for feeding combustible material into the combustor. The combustor 10 is formed of a plurality of water cooled pipes 14 joined together by perforated strips 15 welded between the pipes to define a cylinder 16. The perforations of the strips 15 consist of a plurality of holes or openings 17 running the length of the cylinder 16.

The pipes 14 end in annular header pipes 18 and 19 at each end of the cylinder. A rotary joint 20 feeds water to, and removes steam and hot water from, the combustor 10 through concentric pipes 21. Water is directed to the header pipe 19, and thence to the combustor pipes 14, and steam from the header pipe 18 is carried back through certain ones of the combustor pipes 14 that do not carry input water and which communicate directly with the steam portion of the pipes 21.

The combustor 10 is mounted for rotation about the axis of the cylinder 16 on support rollers 23 with the axis being tilted so that the cylinder has a high end and a low end. The combustor is slowly rotated through a sprocket 24 in the direction of the arrows.

The furnace 12 is defined by a plurality of boiler pipes 27 having a side opening for the combustor and a bottom opening 28 leading to chutes 29 for ashes and nonburnable materials. The arrangement 13 for feeding combustible material includes a chamber 31, covered by a door 32, beneath the level of a floor 33 from which material can be dumped when the door 32 is moved clear. A reciprocating ram 34 feeds material into the upper open end of the combustor cylinder 16.

As observed above, a basic combustor is further disclosed in said U.S. Pat. No. 3,822,651, a waste feeding ram is disclosed in Ser. No. 07,000,510, filed Jan. 5, 1987, and a wind box air flow control is disclosed in Ser. No. 942,570, filed Dec. 15, 1986, all three of which disclosures are hereby specifically incorporated by reference.

In accordance with the invention, shallow walls 40 are disposed about the sides and upper ends of the holes 17 so as to prevent molten material, typically aluminum when the combustor is used to burn MSW, from flowing or dripping through the holes and into the wind box 11. Preferably, the ends of the walls 40 are rounded so that material flowing from the high to the low end of the combustor is not blocked and its movement arrested. Similarly, the absence of any wall on the lower ends of the openings 17 minimizes blockage and avoids creation of a recess defined by the walls in which material could collect. Molten metal, such as aluminum, will continue to flow past the walls 40 downward in the cylinder 16 and eventually out of the lower end of the combustor into the ash chute 29.

The walls 24 themselves are simple metal forms welded in place. Those familiar with this art will appreciate that the walls 40 can be formed and mounted in place with little increased cost in the manufacture of the combustor.

To some extent, the walls 40 perform a further function in supporting the material being burned in a slightly spaced relationship from what could otherwise be an essentially smooth inner cylindrical surface. The advantages of this function are set forth in U.S. Pat. No. 4,226,584, issued Oct. 7, 1980.

A kind of composite embodiment would be to use round holes for the opening 17 and to form the walls 40 from short lengths of tubing fitted into the holes, the tubing being slotted on the lower or downstream side to define the shallow U-shaped configuration illustrated.

It can readily be seen that substantial maintenance problems could result in having molten aluminum fall through the openings 17 into the wind box 11 and related structure. The walls 40 effectively prevent that from happening in an economical fashion and hence avoid much more expensive maintenance problems.

I claim as my invention:

1. In a combustor having a plurality of water cooled pipes secured together with a metal strip disposed between adjacent pipes to define an inner generally cylindrical surface and mounted for rotation about the axis of said surface, said strips having a plurality of openings so disposed therein that said cylindrical surface is gas porous, the improvement comprising, means defining shallow walls circumscribing said openings for preventing molten material on said cylindrical surface from flowing through said openings.

2. The combination of claim 1 in which said axis is tilted so that said cylindrical surface has a high end and a low end, and said wall means being shallow U-shaped walls surrounding the sides and high ends of said openings leaving the lower ends open.

* * * * *